US005881882A

United States Patent [19]

Fletcher et al.

[11] Patent Number: 5,881,882

[45] Date of Patent: Mar. 16, 1999

[54] PLASTIC BAG PACK ADAPTED TO LEAVE NO RESIDUE ON A SUPPORTING RACK

[75] Inventors: Wade D. Fletcher; Harry B. Wilfong, Jr., both of Hartsville; Jeffrey S. Vance, Florence, all of S.C.

[73] Assignee: Sonoco Products Company, Hartsville, S.C.

[21] Appl. No.: 64,454

[22] Filed: Apr. 22, 1998

Related U.S. Application Data

[63] Continuation-in-part of Ser. No. 674,893, Jul. 3, 1996, Pat. No. 5,845,779.

[51] Int. Cl.[6] ..... B65D 33/14

[52] U.S. Cl. ..... 206/554; 383/9

[58] Field of Search ..... 206/449, 451, 206/493, 554; 383/7, 9, 37

[56] References Cited

U.S. PATENT DOCUMENTS

| | | | |
|---|---|---|---|
| Re. 33,264 | 7/1990 | Baxley et al. . | |
| 3,348,760 | 10/1967 | Hinsken et al. . | |
| 4,519,504 | 5/1985 | Nausedas | 206/554 |
| 4,537,310 | 8/1985 | Thul . | |
| 4,560,067 | 12/1985 | Reimann . | |
| 4,562,925 | 1/1986 | Pistner . | |
| 4,676,378 | 6/1987 | Baxley et al. . | |
| 4,785,938 | 11/1988 | Benoit, Jr. et al. . | |
| 4,796,759 | 1/1989 | Schisler . | |
| 4,811,417 | 3/1989 | Prince et al. . | |
| 4,883,450 | 11/1989 | Benoit . | |
| 4,981,216 | 1/1991 | Wilforng, Jr. . | |
| 4,989,732 | 2/1991 | Smith . | |
| 4,995,860 | 2/1991 | Wilfong, Jr. . | |
| 5,074,674 | 12/1991 | Kuklies et al. . | |
| 5,188,235 | 2/1993 | Pierce et al. . | |
| 5,207,328 | 5/1993 | Bose et al. . | |
| 5,269,605 | 12/1993 | Nguyen . | |
| 5,335,788 | 8/1994 | Beasley et al. . | |
| 5,346,310 | 9/1994 | Nguyen . | |
| 5,465,846 | 11/1995 | Blyth et al. . | |
| 5,670,013 | 9/1997 | Huang et al. . | |

FOREIGN PATENT DOCUMENTS

| | | |
|---|---|---|
| 3831823 | 3/1990 | Germany . |

*Primary Examiner*—Jim Foster
*Attorney, Agent, or Firm*—Alston & Bird LLP

[57] ABSTRACT

A pack of plastic bags which are preferably self-opening are adapted to be mounted on a support rack and leave no residue on the support rack when removed therefrom. The plastic bags include front and rear walls integrally joined at their sides and secured at their bottoms and defining an open mouth portion at the top of the walls. A detaching central tab is formed at the top of each of the walls and each has an aperture therein for mounting the central tabs on a tab retaining device on the rack. The tab of at least the rear wall has a structure to propagate a tear through the tab for detaching the tab from the rack while retaining sufficient strength in the portion of the tab above the mounting aperture to prevent premature tearing of the tab and detaching from the rack.

10 Claims, 4 Drawing Sheets

PLASTIC BAG PACK ADAPTED TO LEAVE NO RESIDUE ON A SUPPORTING RACK

CROSS-REFERENCES TO RELATED APPLICATIONS

This application is a continuation-in-part of U.S. patent application Ser. No. 08/674,893, filed on Jul. 3, 1996, U.S. Pat. No. 5,845,779 which is hereby incorporated herein in its entirety by reference.

FIELD OF THE INVENTION

This invention relates to a pack of plastic bags, which are preferably of the T-shirt type and are self-opening on a supporting rack from one bag to the next bag, and which are specifically adapted to leave no residue on the supporting rack when removed therefrom.

BACKGROUND OF THE INVENTION

For a period of time from the 1970s, plastic grocery bags have been replacing paper bags in the United States for the grocery, fast food and retail products industries because of various inherent advantages in plastic bags. For the most part, these plastic bags have been of the T-shirt type which include front and rear walls integrally joined at their sides and secured together at their bottoms and which define an open mouth portion at the top of the walls. Laterally-spaced handles extend upwardly from opposed sides of the bag at the open mouth portion in the top of the bag to provide ease in carrying of the bag by the consumer. A detaching central tab is provided at the top of each of the walls in the open mouth portion. The handles and the central tab include apertures therein for mounting of the handles and the central tab on a rack which includes two outwardly-extending support arms laterally spaced from each other and a central tab retaining device at the top of a rack frame.

This type of bag/rack system was pioneered as the highly commercially successful QUIKMATE® bagging system and is disclosed in U.S. Pat. No. 4,676,378, now Reissue Patent Re. 33,264, which is assigned to the assignee of the present invention. This system allows a pack of bags constructed as described above to be supported on the rack and to be consecutively opened up one-at-a-time on the rack for loading of groceries or other food or retail products and then removed from the rack and from the bag pack.

An improvement to this bagging system relating to self-opening of the bags in the bag pack one-at-a-time on the bag rack as a loaded bag is removed from the rack was developed by the assignee of the present invention and is disclosed in U.S. Pat. No. 5,335,788. This improvement involves constructing the bags of at least 50 wt. percent high density polyethylene plastic material, corona treating at least an upper portion of the outer surface of the front and rear walls of each of the bags and providing at least one localized compressed area extending transversely through the bag pack in the upper portion of the bags such that the bag pack has a decreased thickness in the compressed area for releasably adhering adjacent corona treated outside wall surfaces defined by the localized compressed area and leaving adjacent inside wall surfaces defined by the localized compressed area unadhered to each other. Further details of this improved bag construction may be seen in the '788 U.S. patent which is incorporated herein by reference.

While the QUIKMATE® bagging system utilizing the inventions of the above two identified patents of the assignee of the present invention has been highly successful and has become the standard in the industry, there have been some attempts to further improve the system by making it easier to open each consecutive bag on the rack. There has also been a desire to avoid leaving any residue of the bag packs on the rack, such as having the detaching mounting tab detach from the rack rather than detach from the bag.

U.S. Pat. Nos. 5,074,674; 5,188,235; 5,269,605; 5,346,310 and 5,465,846 are directed to such attempted improvements to the QUIKMATE® bagging system to provide for ease in opening of each consecutive bag on the rack and/or to provide for a detaching central mounting tab which will detach from the rack and leave no residue on the rack. These patents disclose various concepts relating to rendering of the tab on the front wall of the bag "front-side-free" wherein the front wall of the bag and the mounting tab thereon will simply detach from the tab retaining device of the rack without tearing of the tab. These patents also disclose various configurations of mounting apertures in the central mounting tabs on both the back wall and the front wall of the bags which may include a cut slit or weakening tear line which facilitates tearing of the tab to detach the tab from the rack and leave no residue on the rack.

However, all of these so-called improvements to the QUIKMATE® bagging system to provide these two described advantages have additionally created other problems. These other problems include the lack of sufficient strength in the central mounting tab on the rear wall of the bag to prevent such central tab from prematurely tearing and detaching from the tab mounting device on the rack during opening up of the bag and prior to loading of the bag on the rack. The configurations and structure of the mounting apertures on the bag central mounting tabs also created problems in wedging and, therefore, leaving residue behind a conventional "D-ring" type tab mounting device on the rack which consists of an inverted U-shaped wire loop member extending outwardly from cross frame members on the rack. These problems also exist for plastic bags without handles and having only a central mounting tab extending upwardly from an open mouth of a bag for mounting the bag pack on a suitable rack.

OBJECT AND SUMMARY OF THE INVENTION

Accordingly, it is an object of this invention to overcome the above problems and provide a pack of plastic bags adapted to be used in a suitable bag/rack system and which preferably provide for easy opening of each consecutive bag on the rack and removal of each bag from the rack without leaving any residue of detaching central mounting tabs on the rack, while retaining sufficient strength in the central mounting tab of the rear wall to prevent premature tearing or detaching from the rack, and which prevents undesirable wedging of the central mounting tab on the rack.

It has been found by this invention that the above object may be accomplished by providing a pack of plastic bags, preferably of the T-shirt type, adapted to be mounted in a generally vertical suspended position on a rack which includes at the top thereof two outwardly-extending support arms laterally spaced from each other and a central tab retaining device of an inverted U-shaped wire loop type having a predetermined width, known as a "D-ring". Each of the bags include front and rear walls integrally joined at their sides and secured together at their bottoms and defining an open mouth portion at the top of the walls. Laterally-spaced upwardly-extending handles are provided on each side at the top of the bag and each has an aperture therein for mounting the handles on the respective support arms of the rack. A detaching central tab is positioned at the top of each of the walls of the bag and each has an aperture therein for mounting the central tab on the tab retaining device of the rack.

The aperture in the tab of at least the rear wall preferably has a means or structure to propagate a tear from the tab mounting aperture to the open mouth for detaching of the tab from the rack tab retaining device while retaining sufficient strength in the portion of the tab above the mounting aperture to prevent premature tearing of the tab and detaching from the rack tab retaining means. This tear propagating means preferably is in the form of a V-shaped cut-out at the top of the detaching central tab and a nick formed in the bag wall and extending toward the tab mounting aperture from the V-shaped cut-out.

Preferably, the aperture in the tab of both the front and rear walls of the bag has a maximum width dimension in the relaxed condition thereof prior to mounting on the rack which is less than the predetermined width of the tab retaining device of the rack and has a minimum width dimension in the stretched condition thereof after mounting on the rack which is greater than the predetermined maximum width of the tab retaining device of the rack so that the tab mounting apertures of the bag will be stretched over the tab retaining device of the rack when the bags are mounted on the rack to prevent wedging of the bag detaching tabs behind the tab retaining device of the rack and provide for complete detachment of the tab from the rack. This maximum width dimension of the tab apertures in the relaxed condition is preferably less than 1.25 inches and the maximum width dimension of the tab apertures in the stretched condition is preferably greater than 1.25 inches, which is the conventional width of a "D-ring" inverted U-shaped wire loop retaining device used on racks of the conventional QUIKMATE® bag/rack system.

In one embodiment of bag packs constructed in accordance with this invention, each of the apertures in the detaching tabs of both the front and rear walls of the bags has the tear propagating means formed therein. In another embodiment of this invention, the tab of the front wall of the bags includes a cut slit formed in the wall and extending from the top of the aperture to the top of the wall in the open mouth portion to render the detaching tab on the front wall of the bag "front-side-free".

The T-shirt type plastic bags of this invention are preferably constructed of polyethylene film and at least the upper portion of the outer surfaces of the front and rear walls of each of the bags is corona treated with at least one localized compressed area extending transversely through the bag pack in the upper portion of the bag such that the pack has a decreased thickness in the compressed area and wherein adjacent outer wall corona-treated surfaces defined by the localized compressed areas are releasably adhered together and adjacent inside wall surfaces defined by the localized compressed areas are not adhered together for providing a self-opening bag pack.

The shape of the apertures in the detaching central tab of the T-shirt plastic bags of this invention may take various configurations as long as the maximum width dimension of the apertures in the relaxed condition thereof is less than, and the minimum width dimension of the apertures in the stretched condition is greater than, the inverted U-shaped wire loop type tab retaining device of a commonly used conventional rack. These shapes could include circular or flattened elliptical shapes. However, it has been found preferable to define the aperture in the detaching tab by a generally spade shaped cut having a central radial portion and outwardly diverging and downwardly extending linear leg portions extending from the central radial portion to define a flap portion in the detaching tab aperture. Another shape which has been found preferable is a generally fish hook shaped cut defining a flap portion in the aperture. From a manufacturing standpoint, the cutting of an aperture in the central mounting tab and the leaving of a flap portion eliminates undesirable steps of removing bag portions during fabrication which would be required if a circular or elliptical shape cut were utilized to fabricate the aperture. It has also been found desirable to provide radial cut portions at the end of linear cuts in any of the cuts utilized for forming the apertures in the mounting tabs so as to prevent undesirable tearing of the detaching tabs from ends of the cut.

BRIEF DESCRIPTION OF THE DRAWINGS

Some of the objects and advantages of this invention have been set forth above and other objects and advantages will appear in the detailed description of the invention to follow, when taken in conjunction with the accompanying drawings, in which.

DETAILED DESCRIPTION OF PREFERRED EMBODIMENTS OF THE INVENTION

In the following detailed description of the invention, various preferred embodiments are described in order to provide a full and complete understanding of the invention and its preferred embodiments. It will be recognized that although specific terms are employed, these are employed in the descriptive and not in the generic sense, and it will be understood that the invention is susceptible to numerous and various alternatives, modifications and equivalents as will be apparent to the skilled artisan.

Figure 8:
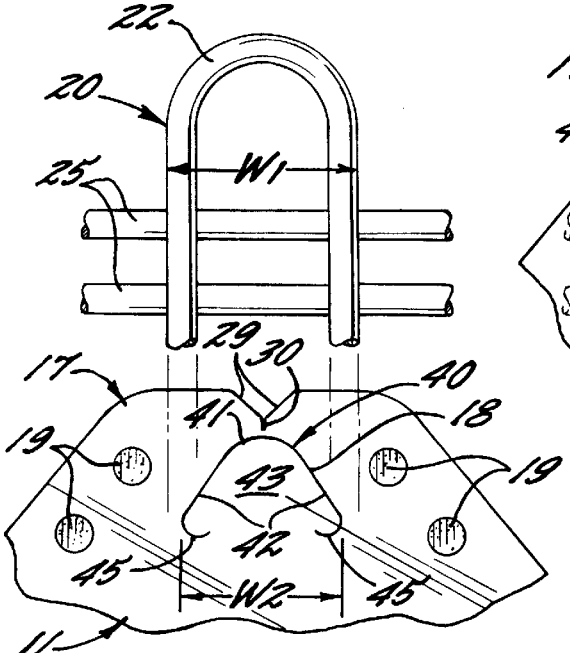
FIG. 8 is an enlarged plan view of the "D-ring" tab retaining device utilized on a conventional QUIKMATE® bag/rack system and one of the detaching central tabs of a T-shirt type plastic bag constructed in accordance with this invention to illustrate the relative maximum width dimensions of each.

Referring now to the drawings, a pack, generally indicated at 10, of T-shirt type plastic bags, generally referred to at 11, are illustrated as being adapted to be mounted in a generally vertical suspended position on a rack, generally indicated at 20. The rack 20 includes at the top of a frame two outwardly-extending support arms 21 laterally spaced from each other and a central tab retaining device 22 of the inverted U-shaped wire loop type having a predetermined width W-1 (as shown in FIG. 8).

The rack 20 may include a generally horizontally extending bag supporting base 24 and suitable vertical and horizontally extending frame members 25. The outwardly-extending support arms 21 extend outwardly from horizontal frame members 25 at the top of vertically extending frame members 25 and the central tab retaining device 22 also extends from horizontally extending frame members 25 at the top of the rack 20. This central tab retaining device 22, as discussed above, is in the form of an inverted U-shaped wire loop and is commonly referred to in the industry as a "D-ring" type tab retaining device. Although there are other rack constructions being utilized in the grocery, fast food and retail products industries, this described rack which is illustrated in the drawings is the more commonly used and conventional rack construction and is utilized in the above discussed QUIKMATE® bag/rack system. The T-shirt type plastic bags of this invention are adapted specifically to be utilized with this described type of rack; however, the improvements of this invention to the bags 11 are also applicable for use with any of the rack constructions currently being utilized in these industries, as will be discussed more fully below.

Each of the bags 11 of the pack 10 generally comprise front and rear walls 12, 13 integrally joined at their sides and secured together at their bottoms and defining an open mouth portion 14 at the top of the walls 12, 13. Each of the bags further comprises laterally-spaced upwardly-extending handles 15 on each side at the top and each having an aperture 16 therein for mounting of the bag handles 15 on the respective support arms 21 of the rack 20. Each of the bags 11 further includes a detaching central tab 17 at the top of each of the walls 12, 13 and each has an aperture 18 therein for mounting the central tabs 17 on the tab retaining device 22 of the rack 20.

The bags 11 of the pack 10 are preferably constructed of polyethylene film and specifically include at least 50 wt. percent high density polyethylene. The bags 11 and the pack 10 also preferably include a corona treatment on at least an upper portion of the outer surface of the front and rear walls 12, 13 of each of the bags 11. The bags 11 also include localized compressed areas 19 extending transversely through the bag pack 10 in the upper portion of the bags 11 such that the bag pack 10 has a decreased thickness in the compressed area for releasably adhering adjacent corona treated outside surfaces of walls 12, 13 defined by the localized compressed areas 19 and leaving adjacent inside surfaces of walls 12, 13 defined by the localized compressed areas 19 unadhered to each other. This construction allows self-opening of each of the bags 11 in the pack 10 one-at-a-time on the bag rack 20 as a loaded bag 11 is removed from the rack 20 and the pack 10, as is shown in FIGS. 3, 7 and 10A–C, and as is described more fully in the above discussed U.S. Pat. No. 5,335,788.

The above generally described bag pack 10 and rack 20 form the QUIKMATE® bagging system as disclosed and described in assignee's U.S. Pat. No. 4,676,378, now Reissue Patent Re. 33,264, and assignee's improvement U.S. Pat. No. 5,335,788, as discussed above. The improvements of the present invention are specifically adapted for use with this type of bag/rack system; however, it is to be understood that these improvements can also be utilized with other modified bag and/or rack constructions.

Figure 7:
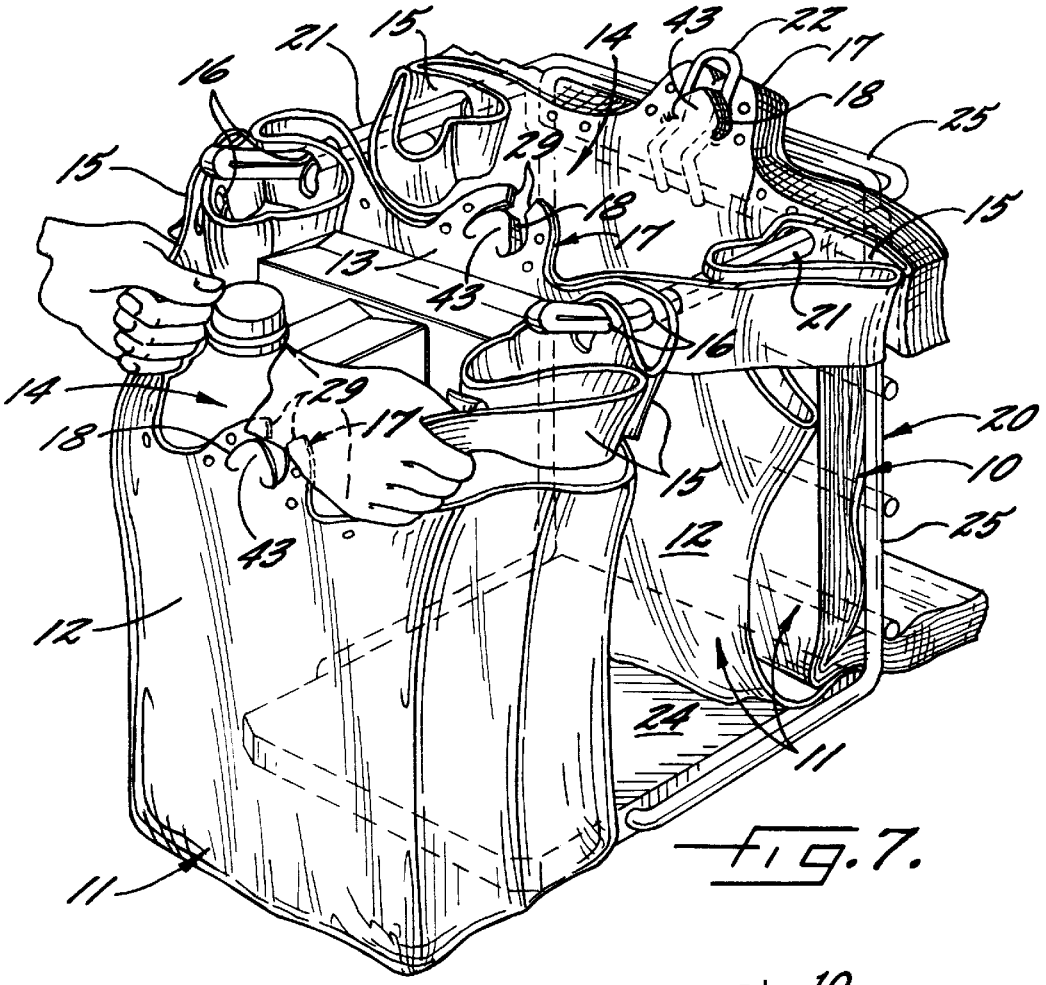
FIG. 7 is a perspective view of a bag pack mounted on a conventional rack showing a filled bag being removed from the rack and bag pack and the next consecutive bag being opened on the rack for filling.

In accordance with the present invention, each of the bags 11 of the pack 10 further include a means to propagate a controlled tear from the tab mounting aperture 18 to the open mouth 14 for detaching the tab 17 from the rack tab retaining device 22 while retaining sufficient strength in the portion of the tab 17 above the mounting aperture 18 to prevent premature tearing of the tab and detaching from the rack tab retaining device 22, as may be seen in FIG. 7. This tear propagating means is preferably in the form of a V-shaped cut-out 29 formed in and extending downwardly from the top of at least the rear wall 13 of the central tab 17 and a nick 29 formed at the apex of the V-shaped cut-out and extending downwardly therefrom toward the tab mounting aperture 18. When stresses are placed on the detaching central tab 17 having this tear propagating means therein, stresses are concentrated by the V-shaped cut-out 29 into the nick 30 to propagate a tear down through the wall of the detaching central tab 17 to the aperture 18. Since the nick 30 does not directly communicate with the tab mounting aperture 18, sufficient strength is provided in the portion of the tab 17 above the mounting aperture 18 to prevent premature tearing of the tab and detaching from the rack tab retaining device 22.

It has been found by experimentation that without the tear propagating means 29, 30 therein it would take a force of approximately 5 lbs. to tear the detaching central tab 17 from the tab mounting aperture 18 to the open mouth 14 and that this tear would not be controlled and would result in a jagged and unsightly tear. With the tear propagating means 29, 30, it has been found that a force of approximately 2 lbs. will cause a controlled tear to propagate from the tab mounting aperture 18 to the open mouth 14 through the detaching central tab 17 so as to provide a neat tear through such central tab 17 for detaching the central tab from the tab retaining device 22 of the rack 20.

If a separate cut slit was provided from the mounting aperture 18 of the detaching central tab which extends towards but not all the way to the open mouth 14 of the bag 11 (as proposed in the above identified prior art patents), a lesser force would be required to cause a tear from the aperture 18 of the tab 17 to the open mouth of the bag and sufficient strength would not be retained in the central tab 17 of at least the rear wall 18 to maintain such central tab 17 on the tab retaining device 22 of the rack 20 while a bag 11 is opened up and being loaded on the rack 20.

Figure 1:
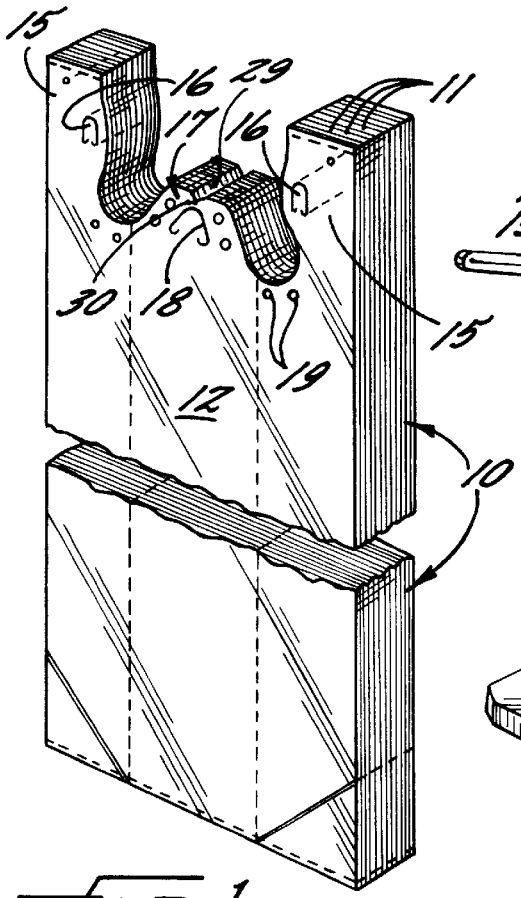
FIG. 1 is a perspective view, broken away, of a bag pack constructed in accordance with this invention.
Figure 3:
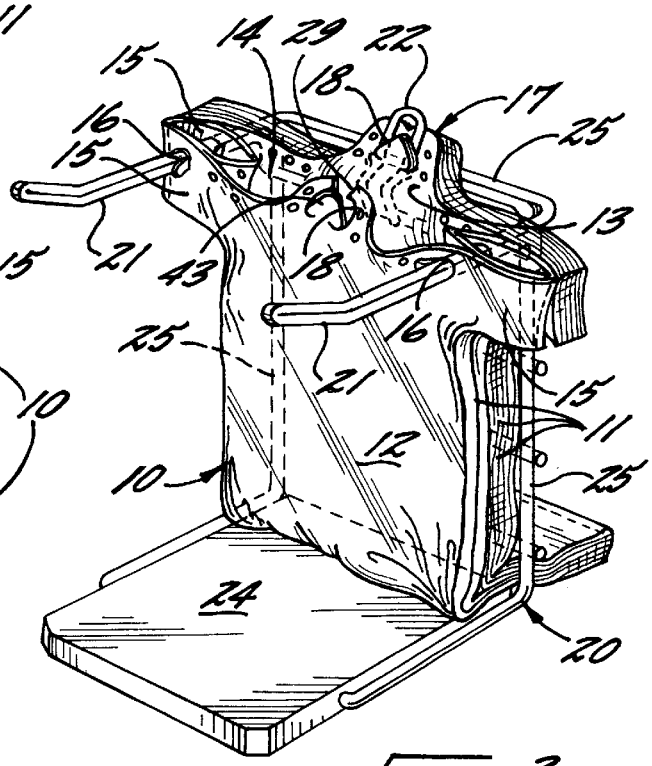
FIG. 3 is a perspective view of the bag pack of FIG. 1 mounted on a rack and with the front bag of the bag pack being opened on the rack.
Figure 2:
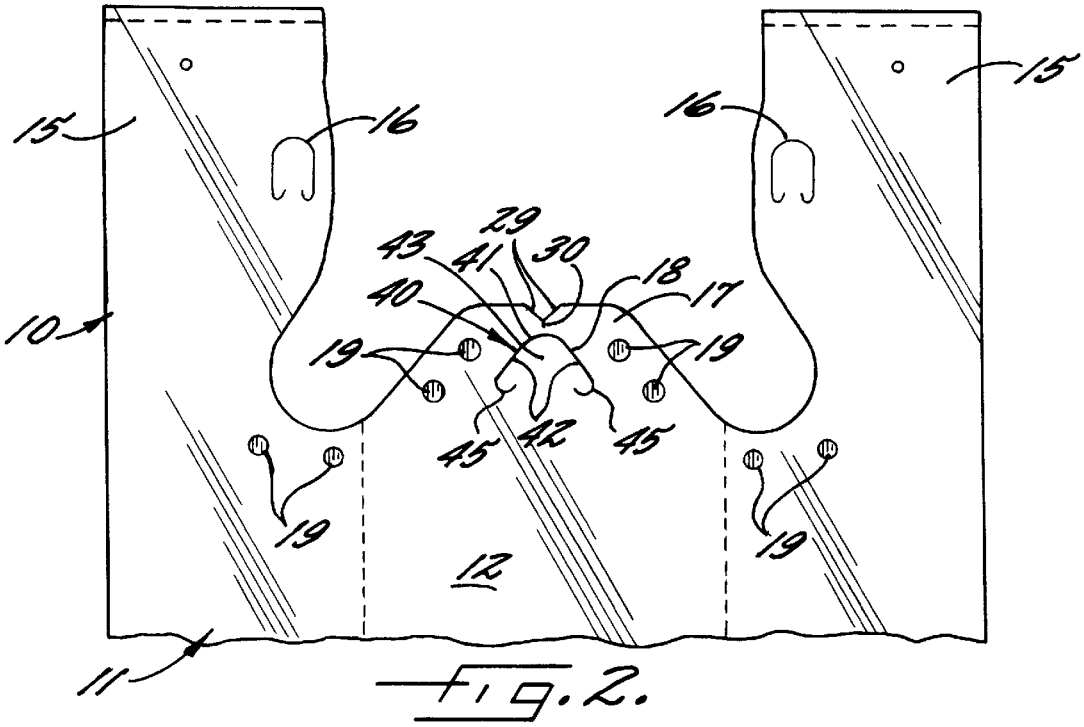
FIG. 2 is an enlarged partial front elevational view of the bag pack of FIG. 1 showing the upper portion of such bag pack.
Figure 4:
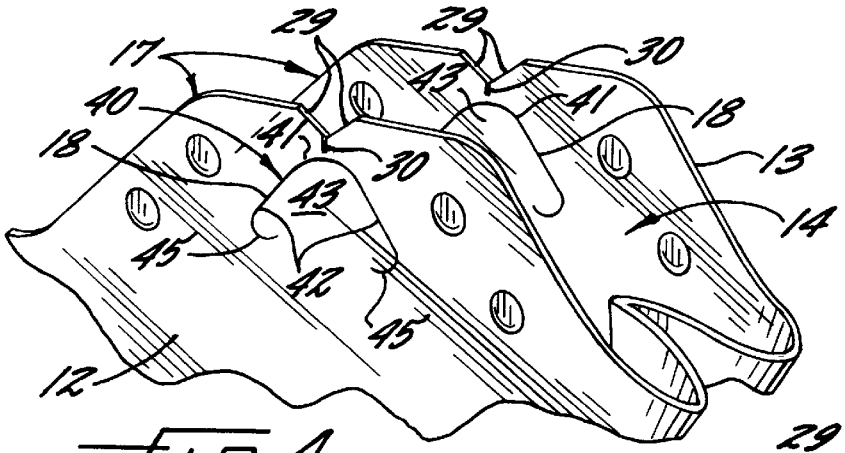
FIG. 4 is an enlarged partial perspective view of one embodiment of detaching central tabs on the front and rear walls at the top of a bag constructed in accordance with this invention.
Figure 5:
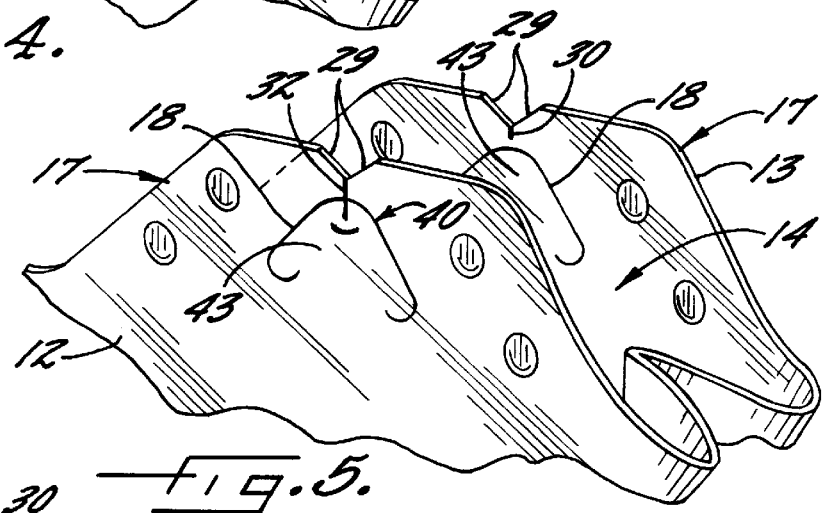
FIG. 5 is a view, like FIG. 4, illustrating a second embodiment of detaching central tabs on the top of front and rear walls of a bag.

In one preferred embodiment of the invention, as illustrated in FIG. 4, each of the apertures 18 in the detaching central tabs 17 of both the front and rear walls 12, 13 of the bags 11 in the pack 10 have a tear propagating means 29, 30 therein for detaching of the tabs 17 from the tab retaining device 22 of the rack 20 while retaining sufficient strength in the portion of the tab 17 above the mounting aperture 18 to prevent premature tearing of the tab 17 and detaching from the rack tab retaining device 22. In another embodiment of this invention, as shown in FIG. 5, the detaching tab 17 on the front wall 12 of each bag 11 in the pack 10 includes a cut slit 32 extending from the mounting aperture 18 to the top of the wall 12 at the mouth 14 of the bag to render the detaching tab 17 on the front wall 12 of each of the bags 11 front-side-free to further assist in easy-opening of each of the bags 11 on the rack 20 as the bags 11 from the pack 10 are consecutively opened on the rack 20.

Figure 9:
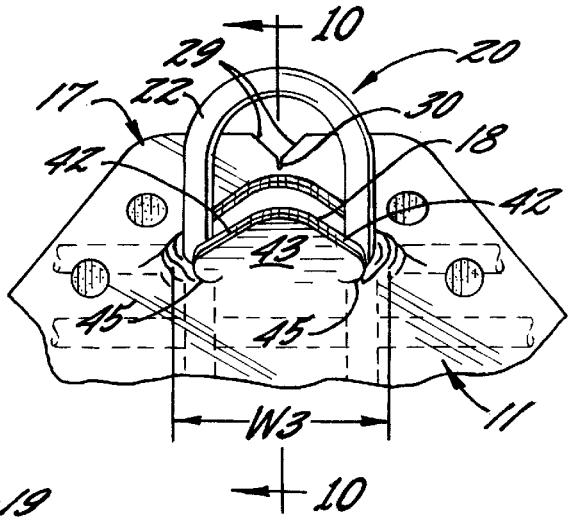
FIG. 9 is a view, like FIG. 8, with the detaching central tab of the bag stretched over and mounted on the tab retaining device of the rack.
Figure 10A:
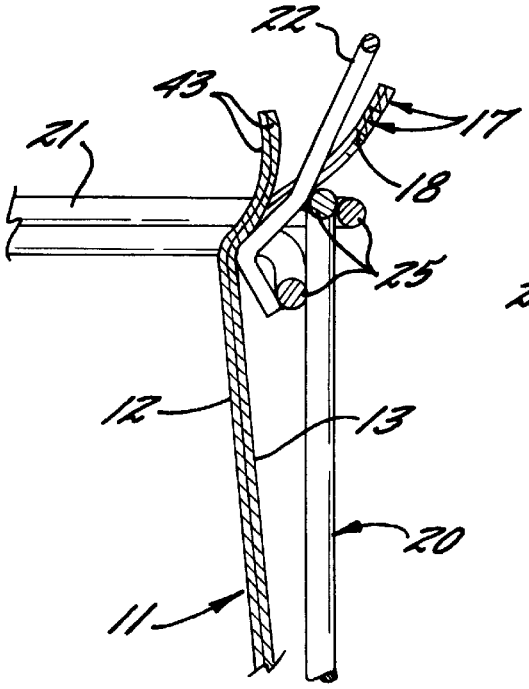
FIGS. 10A, 10B and 10C are sequential views, taken generally along the line 10—10 of FIG. 9, illustrating the consecutive opening and removing of a bag from a bag pack mounted on a rack.
Figure 10B:
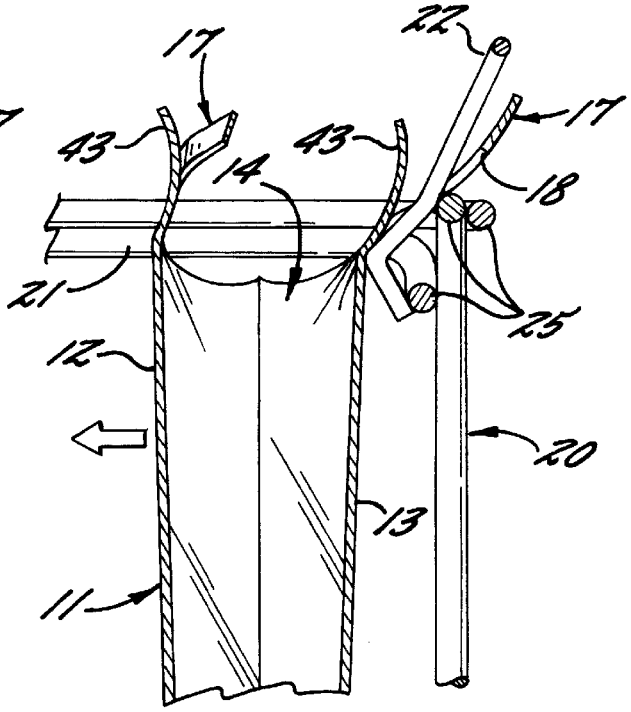
Figure 10C:
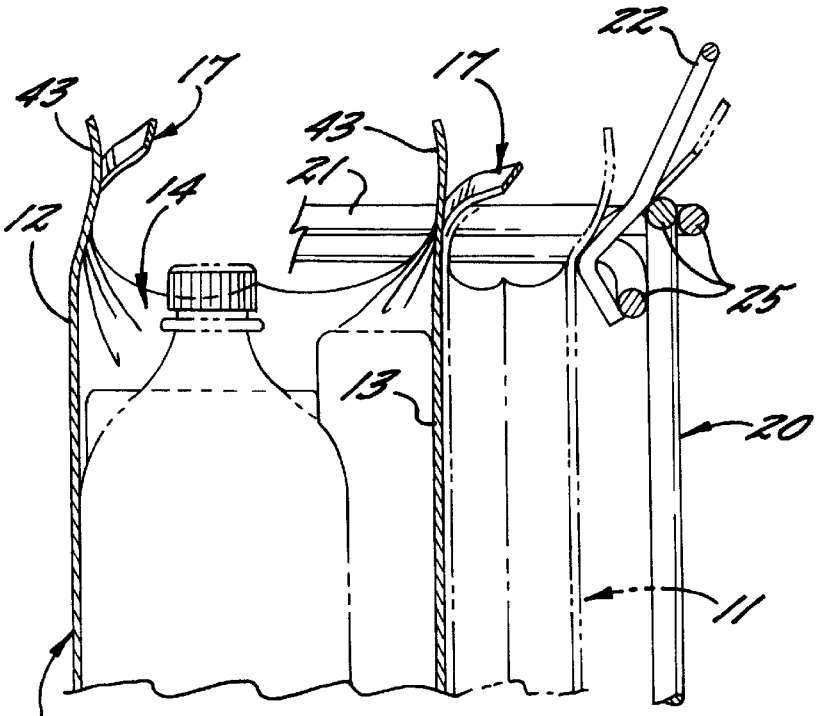

In accordance with another feature of this invention, the aperture 18 in the tab 17 of both the front and rear walls 12, 13 of each of the bags 11 of the pack 10 have maximum width dimension W2 in the relaxed condition thereof (prior to being mounted on the rack 20 and as shown in FIG. 8) which is less than the predetermined width W1 of the tab retaining device 22 of a conventional rack 20 and have a minimum width dimension W3 in the stretched condition thereof (after being mounted on the rack 20 and as shown in FIG. 9) which is greater than the predetermined width W1 of the tab retaining device 22 of a conventional rack 20. This width relationship adapts the central mounting tab 17 of each of the bags 11 to be stretched over the tab retaining device 22 of the rack 20 when the bags 11 of the pack 10 are mounted on the rack 20. This stretching of the tab 17 and the apertures 18 therein over the tab retaining device 22 of the rack 20 positions and maintains the tabs 17 higher up on the tab retaining device 22 and prevents the tabs 17 from wedging between the tab retaining device 22 and the horizontal rack frame members 25 and assists in complete detachment of the tabs 17 from the rack 20. This stretching action also cooperates with the tear propagating means 29, 30 by putting stress on such means 29, 30 to propagate a tear through the tab 17 when detachment of the tab 17 is desired from the tab retaining device 22.

In accordance with this invention it has been found that the width W2 of the apertures 18 of the detaching tabs 17 of the bags 11 should be less than and that the width W3 of the apertures 18 of the detaching tabs 17 of the bags 11 should be greater than 1.25 inches, which is the standard width W1 of a "D-ring" type tab retaining device on a conventional rack 20. While the above described dimension of the apertures 18 in the detaching tab 17 of each of the bags 11 is specifically designed and adapted to be used with a conventional "D-ring" U-shaped wire loop type central tab retaining device 22 on a rack 20, it may also be utilized with other types of narrower or non-looped tab retaining devices, such as disclosed in the above referenced prior art patents which include J-shaped wire tab retaining device.

As mentioned above, the shape of the aperture 18 in the detaching central tabs 17 of the T-shirt plastic bags 11 of this invention may take various configurations as long as the maximum width dimension W2 of the aperture 18 in the relaxed condition thereof is less than and the minimum width dimension W3 of the aperture 18 in the stretched condition thereof is greater than the width W1 of the inverted U-shaped wire loop type tab retaining device 22 of a commonly used conventional rack 20. However, it has been found particularly preferable in accordance with this invention to define the aperture in the detaching tab, as shown in FIGS. 1–5 and 7–9, as a generally spade shaped cut 40 having a central radial portion 41 and outwardly diverging downwardly extending linear leg portions 42 extending from the central radial portion 41 to define a flap portion 43 in the detaching tab aperture 18. The ends of the diverging linear leg portions 42 include radial portions 45 extending inwardly therefrom to prevent undesirable tearing of the detaching tabs from the ends of the cut and from the ends of the linear leg portions 42.

Figure 6A:
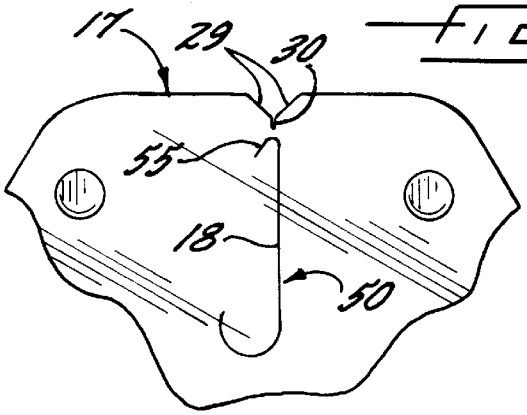
FIGS. 6A, 6B and 6C show alternating configurations of cuts utilized to form the mounting aperture in the central tabs at the top of the front and rear walls of a bag constructed in accordance with this invention.
Figure 6B:
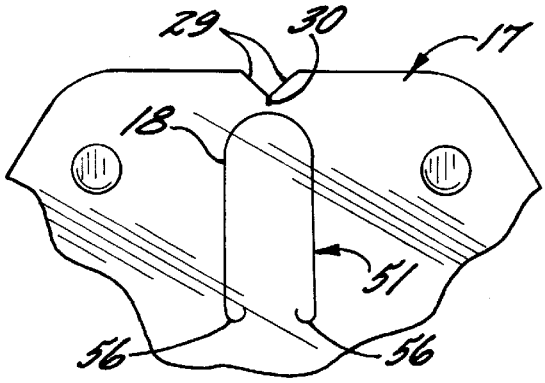
Figure 6C:
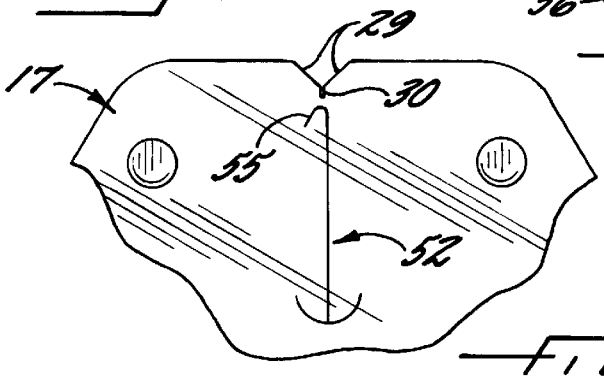

Other shapes or the aperture 18 in the detaching tab 17 of the bags 11 which have the above described width relationships may be in the form of a fish hook shaped cut 50, as shown in FIG. 6A, an inverted U-shaped cut 51 as shown in FIG. 6B or a generally pendulum-shaped cut 52, as shown in FIG. 6C. All of these cuts retain a flap portion in the aperture and eliminates an undesirable step of removing bag portions during fabrication of the aperture 18. The fish hook shaped cut 50 and the inverted U-shaped cut 51 also include radial portions 55, 56, respectively, which extend inwardly from the upper end of the fish hook shaped cut and from the bottom ends of the U-shaped cut to prevent undesirable tearing of the detaching tab from these ends of the cut.

Accordingly, this invention has provided improvements to the QUIKMATE® bag rack system which provides for easy opening of each consecutive bag 11 from a pack 10 on a rack 20 and removal of each bag 11 from the rack 20 without leaving any residue of the detaching central mounting tabs 17 on the rack 20, while retaining sufficient strength in the central mounting tab 17 of at least the rear wall 13 of each bag 11 to prevent premature tearing or detaching of such tab 17 from the rack 20 and which prevents undesirable wedging of the central mounting tabs 17 behind a conventional D-ring tab retaining device 22 of a rack 20 to aid detaching of the tabs 17 from the rack 20 without leaving any residue.

This invention has been described in considerable detail with reference to its preferred embodiments. However, it will be apparent that variations and modifications can be made within the spirit and scope of the invention as described in the foregoing detailed specification and defined in the following claims.

We claim:

1. A pack of plastic bags adapted to be mounted in a generally vertical suspended position on a rack which includes a central tab retaining device, each of said bags comprises:

front and rear walls integrally joined at their sides and secured together at their bottoms and defining an open mouth portion at the top of said walls;

a detaching central tab at the top of each of said walls and each having an aperture therein for mounting the central tabs on the tab retaining device of the rack; and means for propagating a tear from said tab mounting aperture to said open mouth for detaching of said tab from the rack tab retaining device while retaining sufficient strength in the portion of said tab above the mounting aperture to prevent premature tearing of said tab and detaching from the rack tab retaining device, said means comprising a V-shaped cut-out in at least said rear wall and extending from said open mouth at the top of said tab toward said tab mounting aperture and a nick formed in said wall and extending from said V-shaped cut-out toward said tab mounting aperture.

2. A pack of T-shirt type plastic bags adapted to be mounted in a generally vertical suspended position on a rack which includes at the top thereof two outwardly-extending support arms laterally spaced from each other and a central tab retaining device of inverted U-shaped wire loop type having a predetermined maximum width, each of said bags comprises:

front and rear walls integrally joined at their sides and secured together at their bottoms and defining an open mouth portion at the top of said walls;

laterally-spaced upwardly-extending handles on each side at the top and each having an aperture therein for mounting said handles on the respective support arms of the rack;

a detaching central tab at the top of each of said walls and each having an aperture therein for mounting the central tabs on the tab retaining device of the rack; and means for propagating a tear from said tab mounting aperture to said open mouth for detaching of said tab from the rack tab retaining device while retaining sufficient strength in the portion of said tab above the mounting aperture to prevent premature tearing of said tab and detaching from the rack tab retaining device, said means comprising a V-shaped cut-out in at least said rear wall and extending from said open mouth at the top of said tab toward said tab mounting aperture and a nick formed in said wall and extending from said V-shaped cut-out toward said tab mounting aperture.

3. A pack of T-shirt type plastic bags adapted to be mounted in a generally vertical suspended position on a rack which includes at the top thereof two outwardly-extending support arms laterally spaced from each other and a central tab retaining device of inverted U-shaped wire loop type having a predetermined maximum width, each of said bags comprises:

front and rear walls integrally joined at their sides and secured together at their bottoms and defining an open mouth portion at the top of said walls;

laterally-spaced upwardly-extending handles on each side at the top and each having an aperture therein for mounting said handles on the respective support arms of the rack;

a detaching central tab at the top of each of said walls and each having an aperture therein for mounting the central tabs on the tab retaining device of the rack;

means for propagating a tear from said tab mounting aperture to said open mouth for detaching of said tab from the rack tab retaining device while retaining sufficient strength in the portion of the tab above the mounting aperture to prevent premature tearing of the tab and detaching from the rack tab retaining device, said means comprising a V-shaped cut-out in at least said rear wall and extending from said open mouth at the top of said tab toward said tab mounting aperture and a nick formed in said wall and extending from said V-shaped cut-out toward said tab mounting aperture; and said aperture in said tab of both of said front and rear walls having a maximum width dimension in the open relaxed condition thereof prior to being mounted on the rack which is less than the predetermined width of the tab retaining means of the rack and having a minimum width dimension in the stretched condition thereof after being mounted on the rack which is greater than the predetermined width of the tab retaining device of the rack to adapt said tab mounting apertures of said bag to be stretched over the tab retaining device of the rack when said bags are mounted on the rack to prevent wedging of said bag detaching tabs behind the tab retaining device of the rack for complete detachment of said tabs from the rack and to cooperate with the nick to propagate a tear for detaching the bag tabs from the tab mounting device of the rack.

4. A pack of plastic bags, as set forth in claims 1, 2 or 3, in which each of said detaching tabs of both said front and rear wall has said tear propagating means formed therein.

5. A pack of plastic bags, as set forth in claims 1, 2 or 3, in which said tab of said front wall of said bag includes a cut slit formed in said wall and extending from the top of said aperture to the top of said wall in said open mouth portion to render said detaching tab on said front wall of said bags front-side-free.

6. A pack of plastic bags, as set forth in claims 1, 2 or 3, in which each of said bags comprises polyethylene film, in which at least an upper portion of the outer surface of the front and rear walls of each of said bags is corona treated, and in which at least one localized compressed area extends transversely through said bag pack in said upper portion of said bags such that said pack has a decreased thickness in said compressed area, wherein adjacent outer wall corona-treated surfaces defined by said localized compressed areas are releasably adhered together and adjacent inside wall surfaces defined by said localized compressed area are not adhered together for providing a self-opening bag pack.

7. A pack of T-shirt type plastic bags, as set forth in claims 1, 2 or 3, in which each of said apertures in said detaching central tabs is defined by a generally spade shaped cut having a central radial portion and outwardly diverging and downwardly extending linear leg portions extending from the central radial portion to define a flap portion in said detaching tab aperture.

8. A pack of T-shirt type plastic bags, as set forth in claim 7, in which the ends of said diverging linear leg portions of said cut defining said detaching tab aperture include radial portions extending inwardly therefrom to prevent undesirable tearing of said detaching tab from said ends of said cut.

9. A pack of T-shirt type plastic bags, as set forth in claims 1, 2 or 3, in which each of said apertures in said detaching tabs is defined by generally fish hook shaped cut defining a flap portion in said aperture.

10. A pack of T-shirt type plastic bags, as set forth in claim 9, in which the upper end of said fish hook shaped cut defining said detaching tab aperture includes a radial portion extending inwardly therefrom to prevent undesirable tearing of said detaching tab from said cut.

* * * * *